US008430711B2

(12) United States Patent
Chininis et al.

(10) Patent No.: US 8,430,711 B2
(45) Date of Patent: Apr. 30, 2013

(54) INFANT PLAY GYM

(75) Inventors: Stephen Paul Chininis, Norcross, GA (US); Melvin Ray Kennedy, Lantana, FL (US); Jose Longoria, Miami, FL (US)

(73) Assignee: Learning Curve Brands, Inc., Dyersville, IA (US)

( * ) Notice: Subject to any disclaimer, the term of this patent is extended or adjusted under 35 U.S.C. 154(b) by 305 days.

(21) Appl. No.: 12/879,808

(22) Filed: Sep. 10, 2010

(65) Prior Publication Data

US 2011/0065353 A1 Mar. 17, 2011

Related U.S. Application Data

(60) Provisional application No. 61/241,781, filed on Sep. 11, 2009.

(51) Int. Cl.
*A63H 33/00* (2006.01)

(52) U.S. Cl.
USPC ..... 446/227; 446/228; 446/229; 446/236; 472/118; 5/655

(58) Field of Classification Search ..... 446/227–229, 446/236; 5/655; 472/118, 119
See application file for complete search history.

(56) References Cited

U.S. PATENT DOCUMENTS

| | | | | | |
|---|---|---|---|---|---|
| 2,551,317 | A * | 5/1951 | Damiano | 446/229 |
| 2,959,138 | A * | 11/1960 | Foster | 104/117.1 |
| 3,000,138 | A * | 9/1961 | Tagliaferri | 446/229 |
| 3,041,983 | A * | 7/1962 | Liversidge et al. | 104/93 |
| 4,150,820 | A * | 4/1979 | Bochmann | 472/119 |
| 4,664,640 | A * | 5/1987 | Shindo et al. | 446/227 |
| 5,059,463 | A * | 10/1991 | Peters | 428/64.1 |
| D359,869 | S * | 7/1995 | Oren | D6/596 |
| 5,626,504 | A * | 5/1997 | Liu | 446/229 |
| 5,803,786 | A * | 9/1998 | McCormick | 446/227 |
| 5,928,054 | A * | 7/1999 | Mast | 446/227 |
| 5,930,854 | A * | 8/1999 | O'Neill et al. | 5/655 |
| 6,319,138 | B1 * | 11/2001 | Fair et al. | 472/119 |
| 6,464,594 | B1 * | 10/2002 | Canna et al. | 472/119 |
| 6,471,597 | B1 * | 10/2002 | Flannery et al. | 472/119 |
| 6,626,766 | B1 * | 9/2003 | Hsia | 472/119 |
| 6,702,643 | B1 * | 3/2004 | Drosendahl et al. | 446/227 |
| 6,994,630 | B2 * | 2/2006 | Paesang | 472/118 |
| 7,037,170 | B2 * | 5/2006 | Pacella et al. | 446/268 |
| 7,219,959 | B2 * | 5/2007 | Ransil et al. | 297/277 |
| 7,841,572 | B2 * | 11/2010 | Chen et al. | 248/317 |
| 7,918,710 | B2 * | 4/2011 | Bapst et al. | 446/227 |
| 8,070,552 | B2 * | 12/2011 | Snyder | 446/227 |
| 2004/0224823 | A1 * | 11/2004 | Myers et al. | 482/35 |
| 2006/0264148 | A1 * | 11/2006 | Sejnowski et al. | 446/227 |
| 2007/0224909 | A1 * | 9/2007 | Schoenfelder et al. | 446/227 |
| 2008/0182477 | A1 * | 7/2008 | Catelli | 446/71 |
| 2009/0253342 | A1 * | 10/2009 | Oren et al. | 446/227 |
| 2010/0029170 | A1 * | 2/2010 | Hall | 446/227 |
| 2012/0216351 | A1 * | 8/2012 | Hopke et al. | 5/655 |

* cited by examiner

*Primary Examiner* — Gene Kim
*Assistant Examiner* — Urszula M Cegielnik
(74) *Attorney, Agent, or Firm* — Michael Best & Friedrich LLP

(57) ABSTRACT

An infant play gym including a mat, a first arched structure extending over the mat, a second arched structure extending over the mat, and a motion module. The motion module includes a housing couplable to both the first arched structure and the second arched structure, a power source, and a motor positioned within the housing and powered by the power source, the motor operable to cause the first and second arched structures to move with respect to one another.

15 Claims, 11 Drawing Sheets

INFANT PLAY GYM

CROSS-REFERENCE TO RELATED APPLICATION

This application claims the benefit of and priority to U.S. Provisional Patent Application No. 61/241,781 filed on Sep. 11, 2009, the entire contents of which are hereby incorporated by reference.

BACKGROUND OF THE INVENTION

Play gyms are typically used with infants to provide entertainment and education. Typically, a play gym includes two arched structures that are crossed in an X-configuration, and which slot into a mat on which the infant is placed. Several small objects are hung from the arched structures so that the infant can grab the objects while playing.

The objects can include a mirror, one or more objects that make sound when touched, such as "crunchy" material, or may be stuffed animals and toys. Infants can quickly tire of play gyms if they are not continually stimulated, for example, by a caregiver or parent moving one or more of the objects.

SUMMARY OF THE INVENTION

The invention is directed generally to infant play gyms. More specifically, the invention is directed to a play gym having at least two arched structures which are positioned to extend above an infant lying on a support surface. The play gym also has a motor, and a linkage driven by the motor. The motor is connected to a first of the arched structures, and the linkage is connected to a second arched structure such that rotation of the linkage by the motor causes movement of the second arched structure in relation to the first arched structure. At least one of the arched structures can have at least one attachment point for hanging at least one object such as a toy from the arched structure so that the object moves with movement of the arched structures.

In some embodiments, the present invention provides a motion module for use on a play gym having a mat, a first arched structure extending over the mat and having one or more toy elements coupled thereto, and a second arched structure extending over the mat and having one or more toy elements coupled thereto. The motion module includes a housing couplable to both the first arched structure and the second arched structure, a power source, and a motor positioned within the housing and powered by the power source, the motor operable to cause the first and second arched structures to move with respect to one another.

In other embodiments, the present invention provides a motion module for use on a play gym having a mat, a first arched structure extending over the mat and having one or more toy elements coupled thereto, and a second arched structure extending over the mat and having one or more toy elements coupled thereto. The motion module includes a housing including a first coupling member couplable to one of the first arched structure and the second arched structure, and a second coupling member couplable to the other of the first arched structure and the second arched structure, wherein movement of the second coupling member with respect to the first coupling member causes the first and second arched structures to move with respect to one another.

In yet another embodiment, the present invention provides a play gym including a mat having a support surface for supporting an infant, a first arched structure extending over the mat and having one or more toy members coupled thereto, a second arched structure extending over the mat and having one or more toy members coupled thereto, and a motion module. The motion module including a housing having a first coupling member couplable to one of the first arched structure and the second arched structure, and a second coupling member rotatable with respect to the first coupling member and couplable to the other of the first arched structure and the second arched structure, wherein rotation of the second coupling member with respect to the first coupling member causes the first and second arched structures to move with respect to one another Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Although directional references, such as upper, lower, downward, upward, rearward, bottom, front, rear, etc., may be made herein in describing the drawings, these references are made relative to the drawings (as normally viewed) for convenience. These directions are not intended to be taken literally or limit the present invention in any form. In addition, terms such as "first," "second," and "third" are used herein for purposes of description and are not intended to indicate or imply relative importance or significance.

Figure 1:
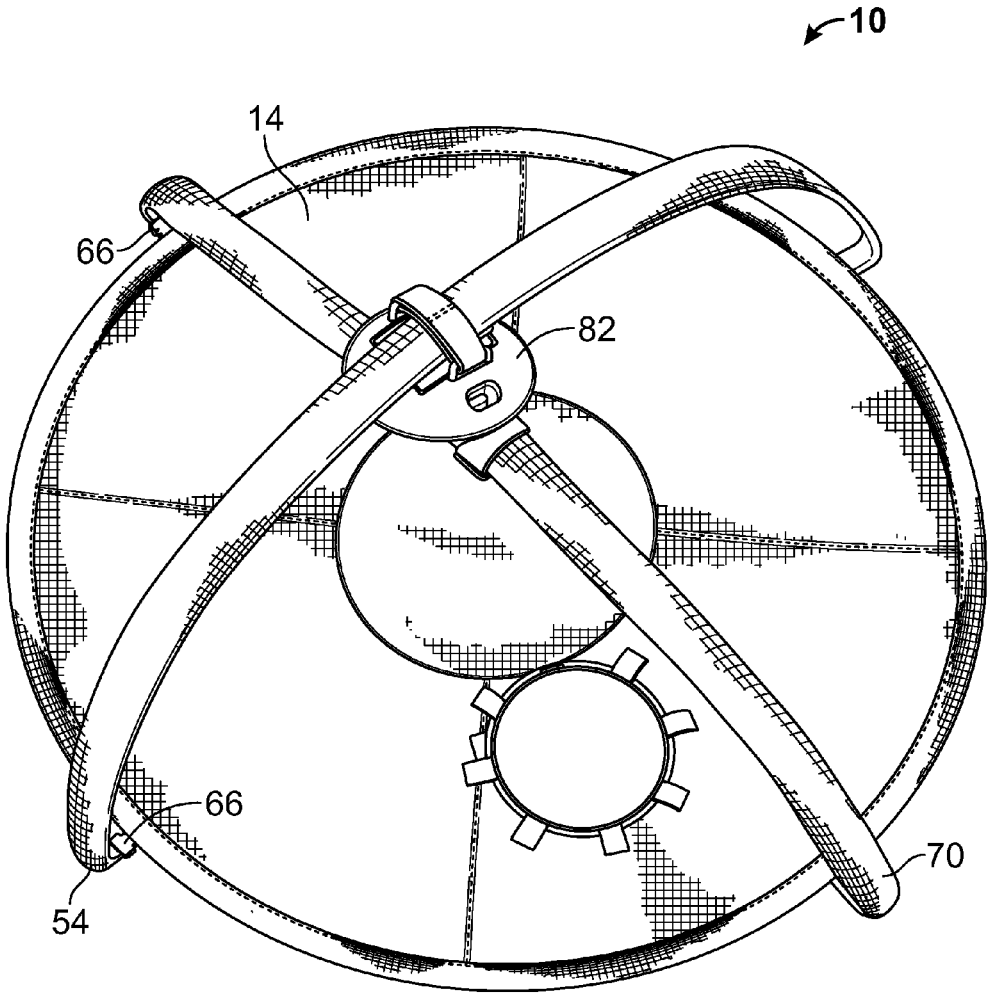
FIG. 1 is a perspective view of a play gym according to one embodiment of the present invention.
Figure 2:
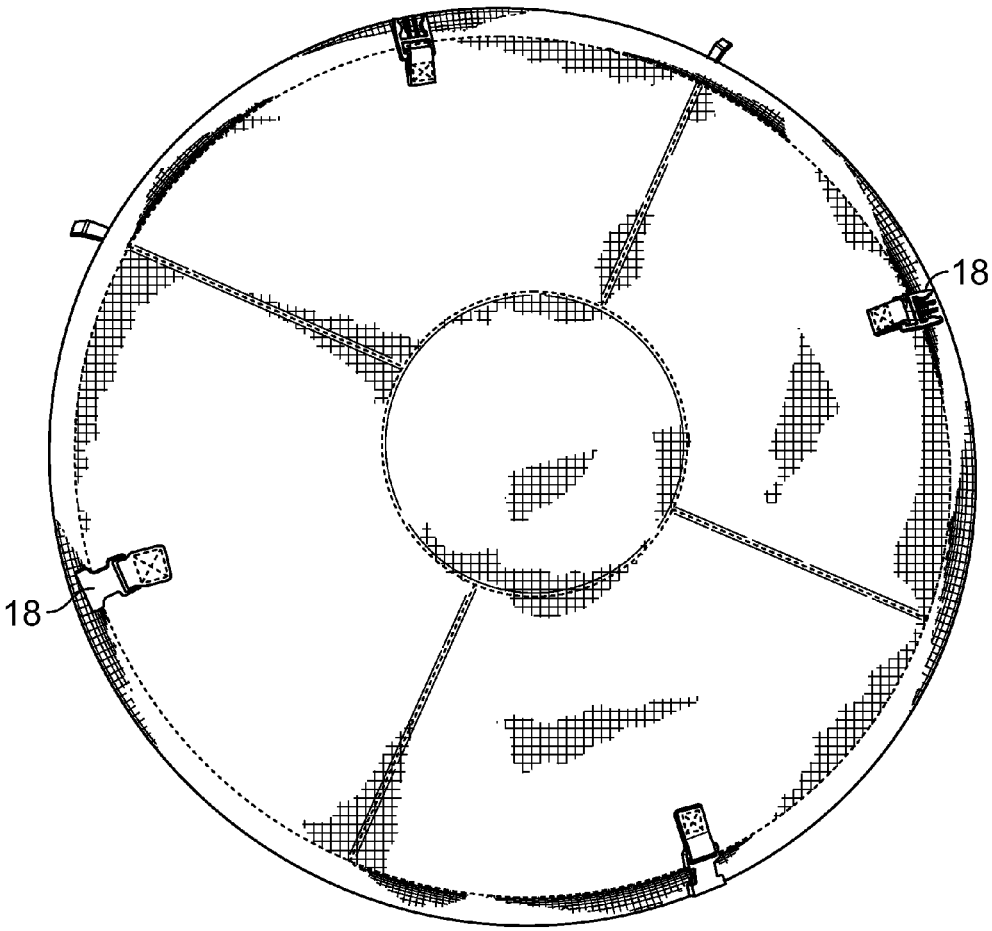
FIG. 2 is a perspective view of a bottom surface of the play gym illustrated in FIG. 1.

FIG. 1 illustrates a play gym 10 according to one embodiment of the present invention. The play gym 10 includes a mat 14 having one or more fabric layers suitable for infant and small child use. The mat 14 includes a defined perimeter and a plurality of connector ends 18 (FIG. 2) spaced around the perimeter (or adjacent to the perimeter) on the top and/or bottom of the mat 14. The connector ends 18 can be different and can be attached to fabric that can then be sewn or otherwise stitched into the top and/or bottom material of the mat 14. The perimeter of the mat 14 as illustrated in FIGS. 1-2 substantially defines a circle, however, the perimeter can assume any desirable shape and size.

Figure 3:
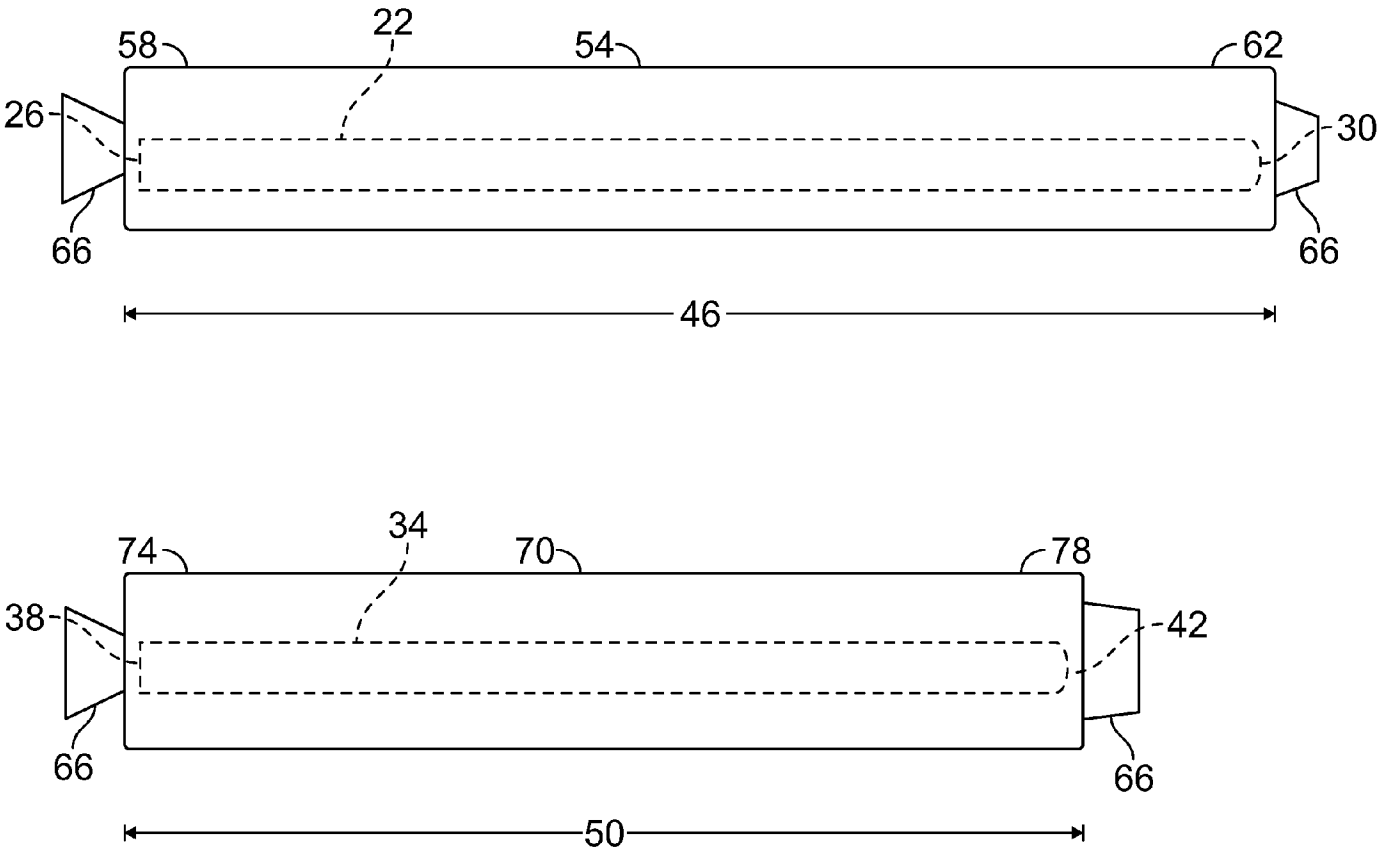
FIG. 3 is a front view of two flexible members of the play gym illustrated in FIG. 1.

As illustrated in FIGS. 1 and 3, the play gym 10 also includes a first flexible member 22 having a first end 26 and a second end 30. The play gym 10 also includes a second flexible member 34 having a first end 38 and a second end 42. The first flexible member 22 includes a predetermined first length 46 while the second flexible member 34 includes a predetermined second length 50. The first length is greater than the second length or vice versa. The lengths represented in the drawings are not to scale. The flexible members 22, 34 assume a substantially straight orientation and comprise a material such as a form of plastic that is substantially rigid, but flexes, curves, or bends when pressure is applied at the ends. When the pressure at the ends is released, the flexible members 22, 34 resume their substantially straight orientation. The flexible members 22, 34 can be whole or partially hollow or may be solid. The flexible members 22, 34 can have a circular cross-section, or other suitable cross-section, such as oval, square, rectangular, diamond, or cross.

The first flexible member 22 is positioned within or encased within or substantially covered with a sleeve of fabric 54 that can be padded. The sleeve of fabric 54 can include one or more loops of fabric positioned along its length. The sleeve of fabric 54 includes a first end 58 and a second end 62 with each end 58, 62 having a connector end 66 complementary to the connector ends 18 on the mat 14. The sleeve of fabric 54 includes a length substantially similar to the predetermined first length 46. The arrangement of connector ends as illustrated in the figures shows that the sleeve of fabric 54 includes a first connector end at one end and a second connector end, different than the first connector end, at the other end of the sleeve of fabric 54.

The second flexible member 34 is positioned within or encased within or substantially covered with a sleeve of fabric 70 that can be padded. The sleeve of fabric 70 can include one or more loops of fabric positioned along its length. The sleeve of fabric 70 includes a first end 74 and a second end 78 with each end 74, 78 having a connector end 66 complementary to the connector ends 18 on the mat 14. The sleeve of fabric 70 includes a length substantially similar to the predetermined second length 50. The arrangement of connector ends as illustrated in the figures shows that the sleeve of fabric 70 includes a first connector end at one end and a second connector end, different than the first connector end at the other end of the sleeve of fabric 70.

The complementary mating connector ends 18 on the mat 14 are positioned substantially opposite one another to allow the connector ends 66 on the sleeves of fabric 54, 70 to mate with the appropriate connector ends 18 on the mat 14. The distance between the oppositely oriented connector ends 18 on the mat is smaller than the predetermined first length 46 and the predetermined second length 50 such that when the connector ends 66 are secured to the connector ends 18, the first flexible member 22 and the second flexible member 34 each bend to form an arch.

The play gym 10 can have various configurations capable of entertaining an infant or small child placed on the mat 14. The sleeves 54, 70 can include one or more loops or attachment points which permit a user to hang or attach small objects such as toys or educational items from the attachment points. Suitable toys or educational items may include stuffed or representational animals, mirrors, toys having brightly colored or black and white visual elements, toys that make a sound such as bells and rattles, tactile toys such as crunchy material for a child to handle, and many other variations. The toys can be removable such that a parent or caregiver can change the toys in order to maintain the child's interest in the play gym.

The flexible members 22, 34 are arranged and dimensioned to extend over the infant or child while the play gym 10 is in use. The flexible members 22, 34, when connected to the mat 18, each bend to form a substantial semi-circle in a defined plane. For example and as illustrated in FIG. 1, the first flexible member 22 bends to form a semi-circle in a first plane while the second flexible member 34 bends to form a semi-circle in a second plane. The first plane and the second plane can be substantially perpendicular to one another or arranged at any other suitable angle (e.g., 60 degrees, 45 degrees, etc.) with respect to one another. In addition, because one of the flexible members 22, 34 is longer than the other, the longer flexible member is on top of the shorter flexible member. For ease of description, we will designate flexible member 22 as being longer than the flexible member 34.

Figure 9:
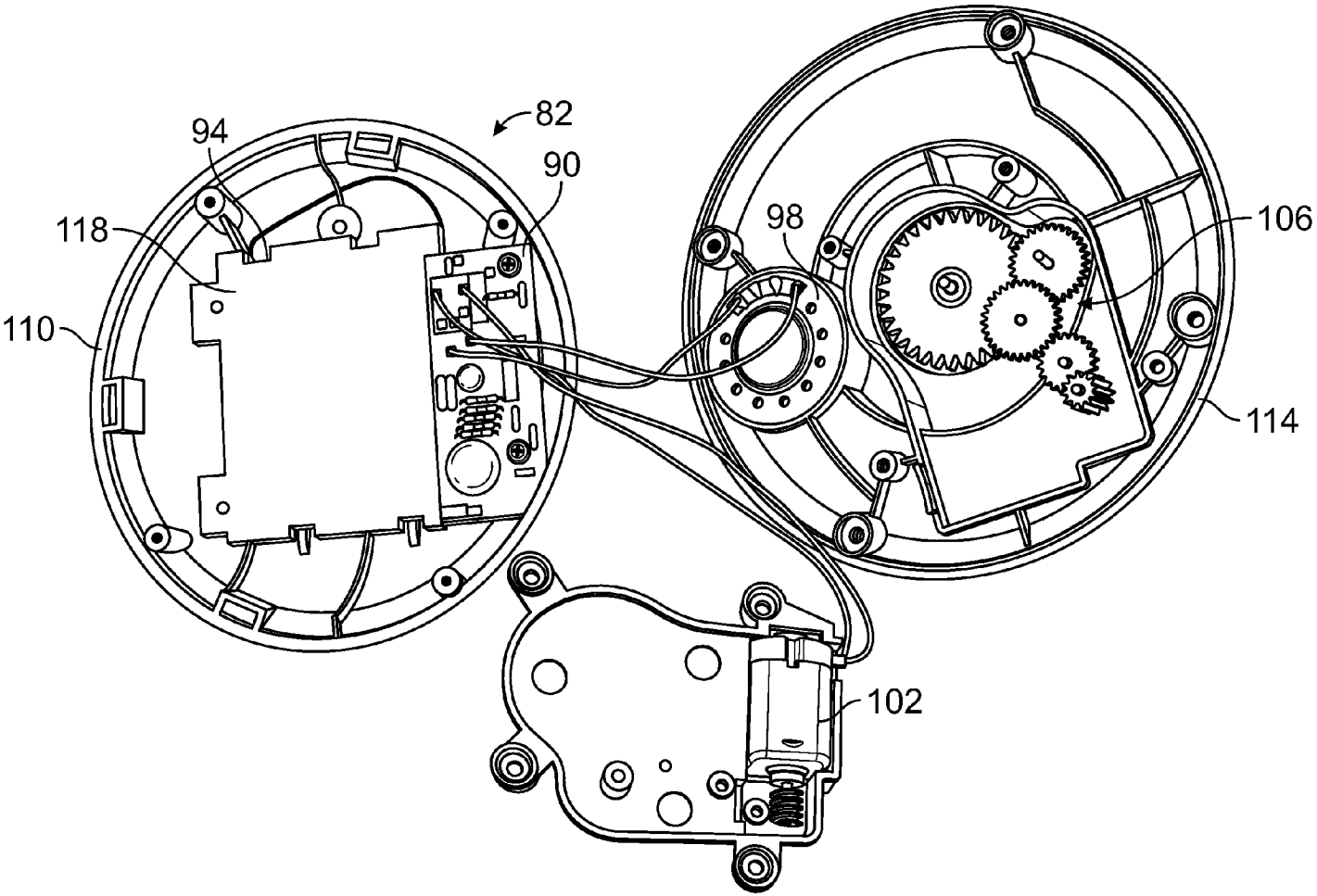
FIG. 9 is a perspective view of the components of the electronics module illustrated in FIG. 4.
Figure 10:
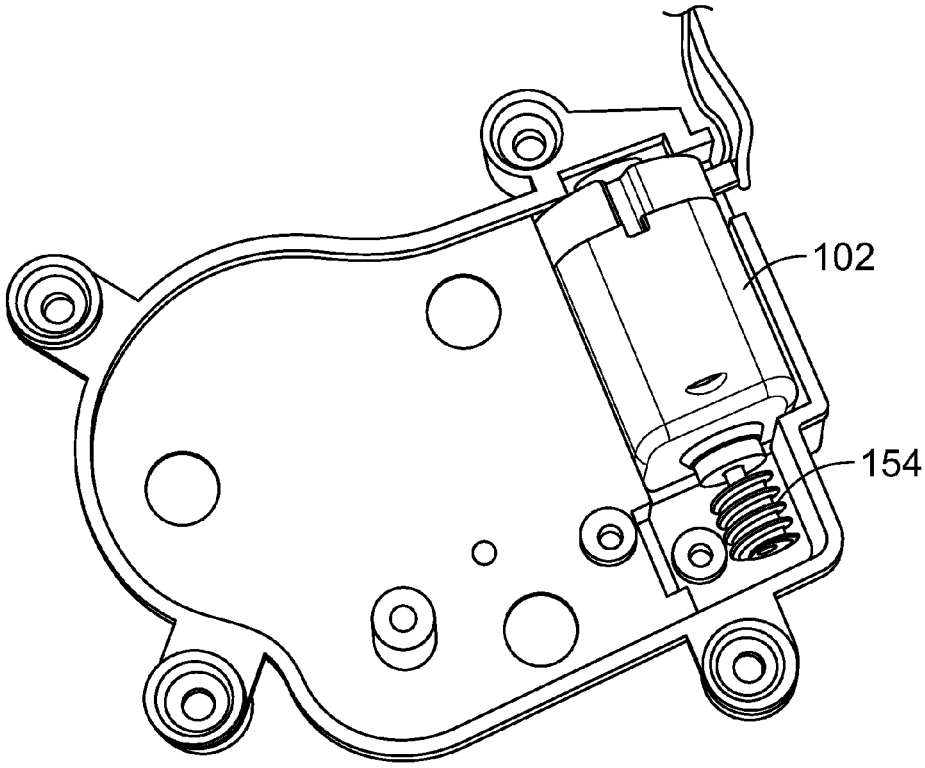
FIG. 10 is an enlarged perspective view of one of the components of the electronics module illustrated in FIG. 9.
Figure 11:
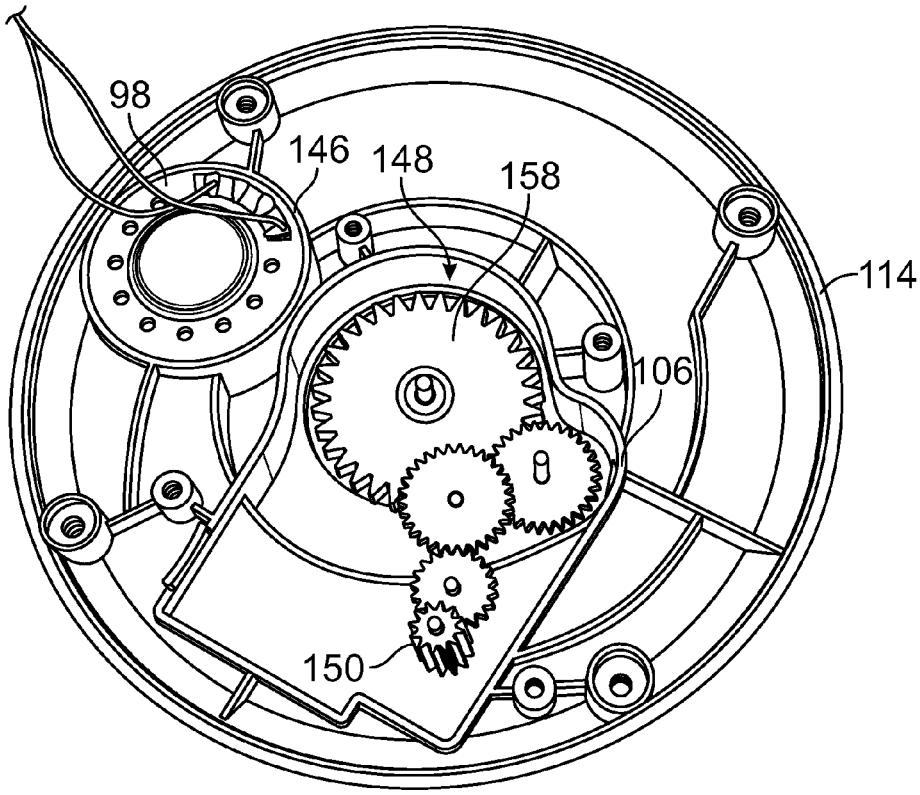
FIG. 11 is an enlarged perspective view of one of the components of the electronics module illustrated in FIG. 9.
Figure 12:
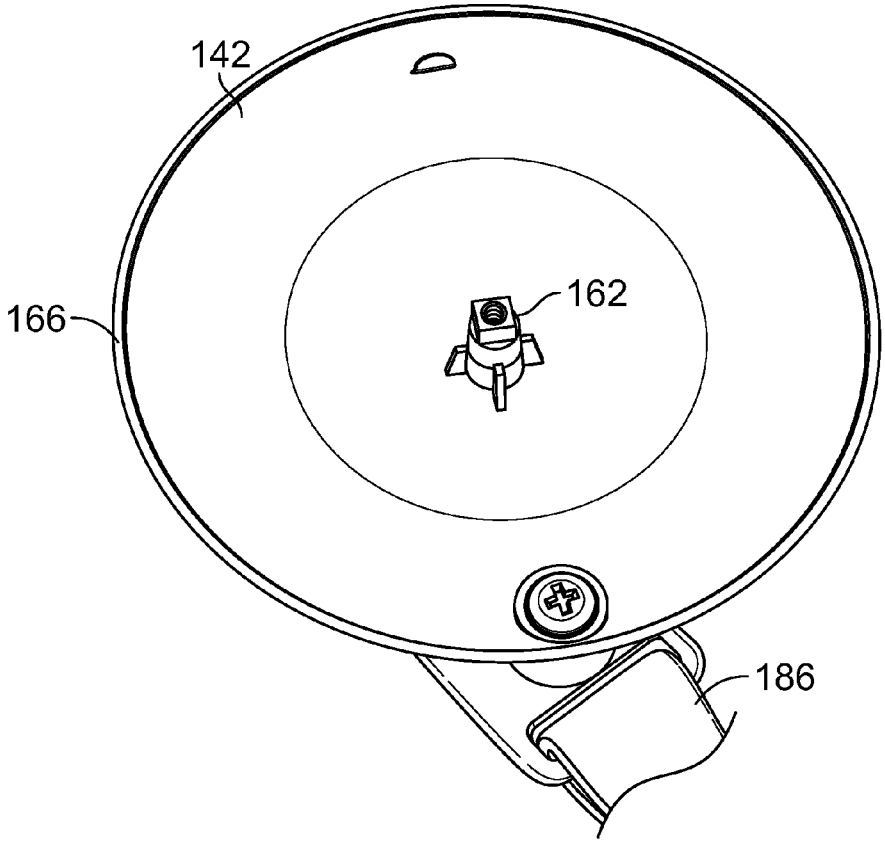
FIG. 12 is an enlarged perspective view of a portion of the electronics module illustrated in FIG. 4.
Figure 13:
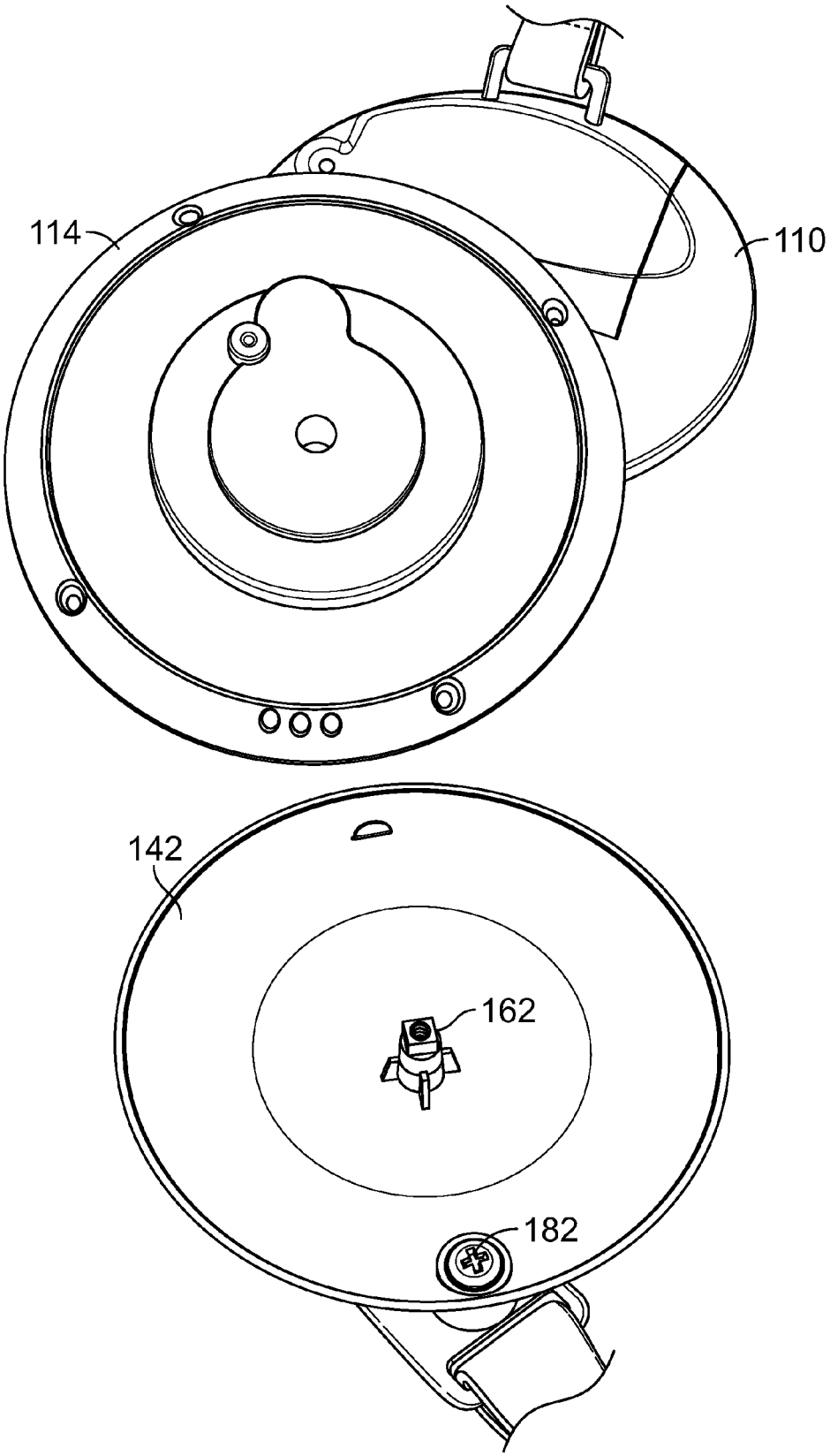
FIG. 13 is a perspective view of a portion of the electronics module illustrated in FIG. 4.
Figure 14:
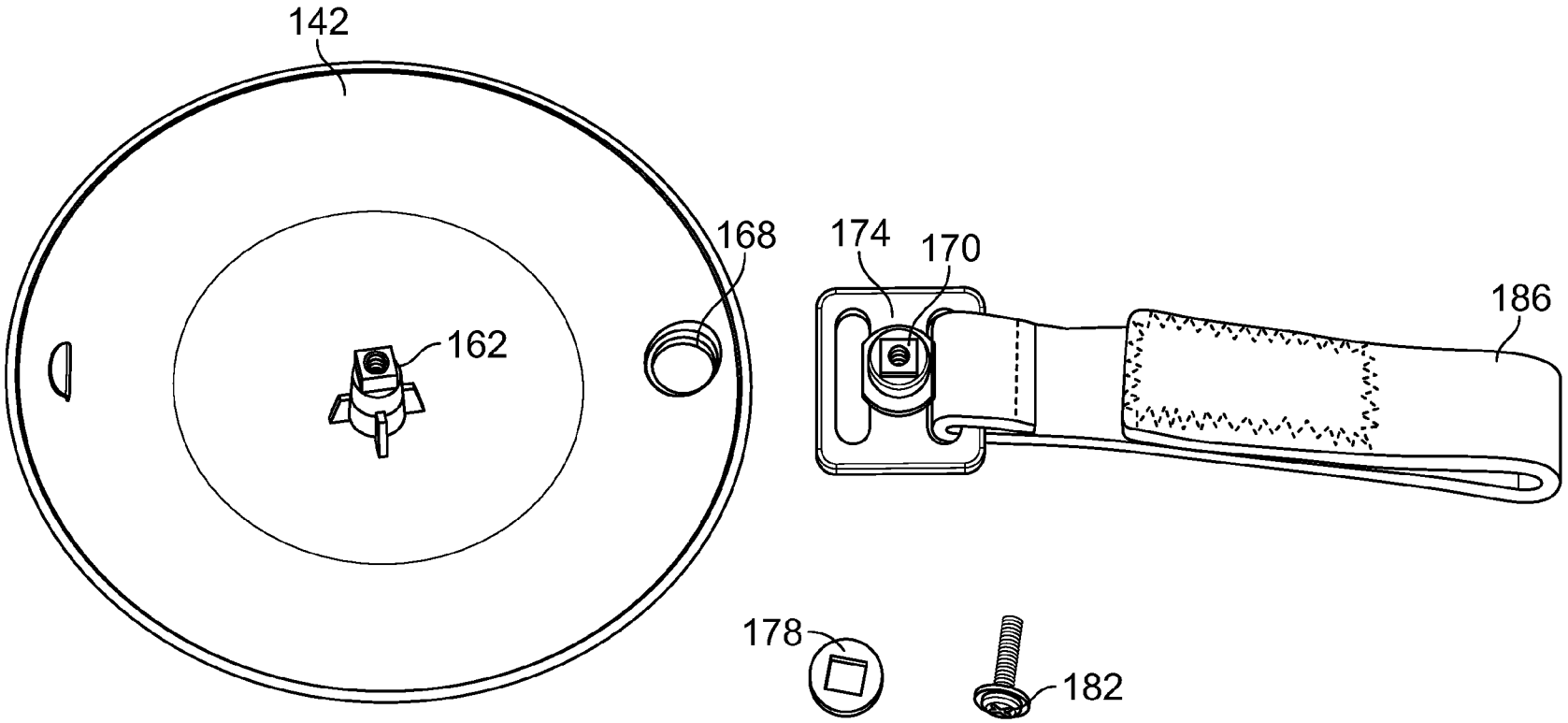
FIG. 14 is an assembly view of a portion of the electronics module illustrated in FIG. 4.

The play gym 10 also includes an electronics module 82 as illustrated in FIGS. 1 and 4-14. The electronics module 82 includes a housing 86 configured to support a processor 90, a power source 94, a speaker 98, a motor 102, and a gear train 106. As illustrated in the figures, the housing 86 includes a first portion 110 and a second portion 114. The first portion 110 includes a compartment or recess 118 configured to support the power source 94, such as one or more batteries. The power source 94 is accessible from an exterior of the housing 86 via a cover 122, which encloses the recess 118. The cover 122 includes a recessed area 126 configured to receive the flexible member 22. The first portion 110 also supports the processor 90 as illustrated in FIG. 9.

Figure 4:
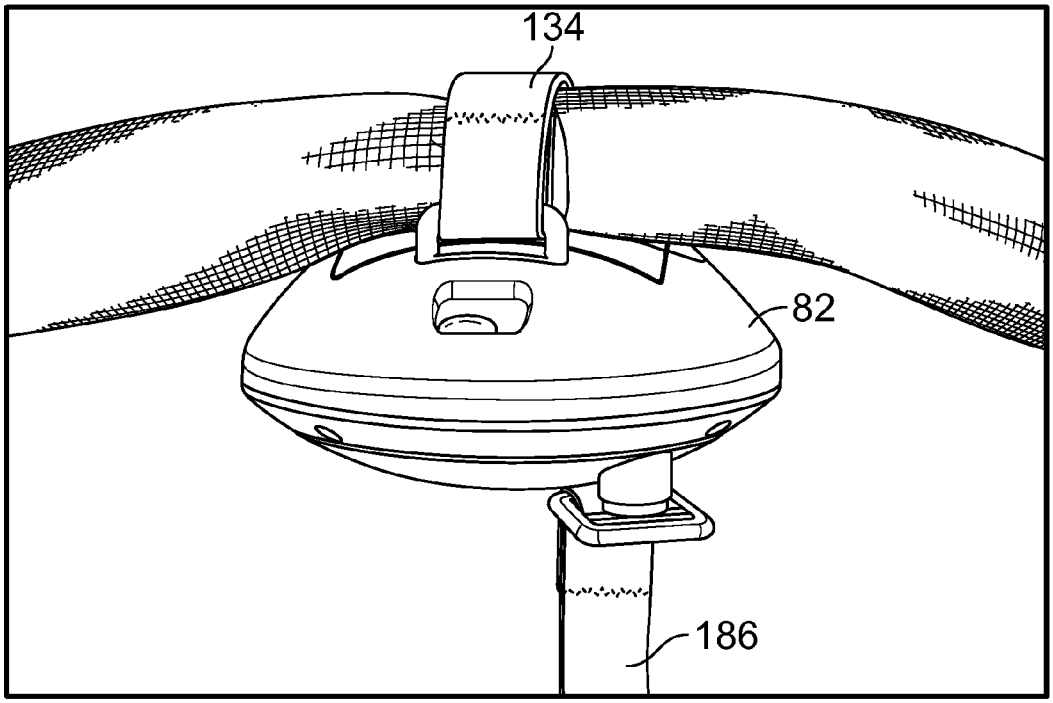
FIG. 4 is a perspective view of an electronics module coupled to a flexible member of the play gym illustrated in FIG. 1.

The housing 86 also includes a plurality of brackets 130 extending from an exterior surface of the first portion 110 on opposites sides of the cover 122. The brackets 130 are configured to support a strap 134 used to couple the housing 86 to one of the flexible members 22, 34. More particularly, the strap 134 wraps around the longer flexible member 22 such that the electronics module 82 hangs from the flexible member 22 as illustrated in FIG. 4. The first portion 110 also includes a switch 138 supported by the housing 14 and operable to provide input from the user to the processor 90. The switch 138 can activate the processor 90 and the motor 102, and can activate various music selections stored in memory on the processor 90. The switch 138 can also activate other features of the electronics module 82.

Figure 5:
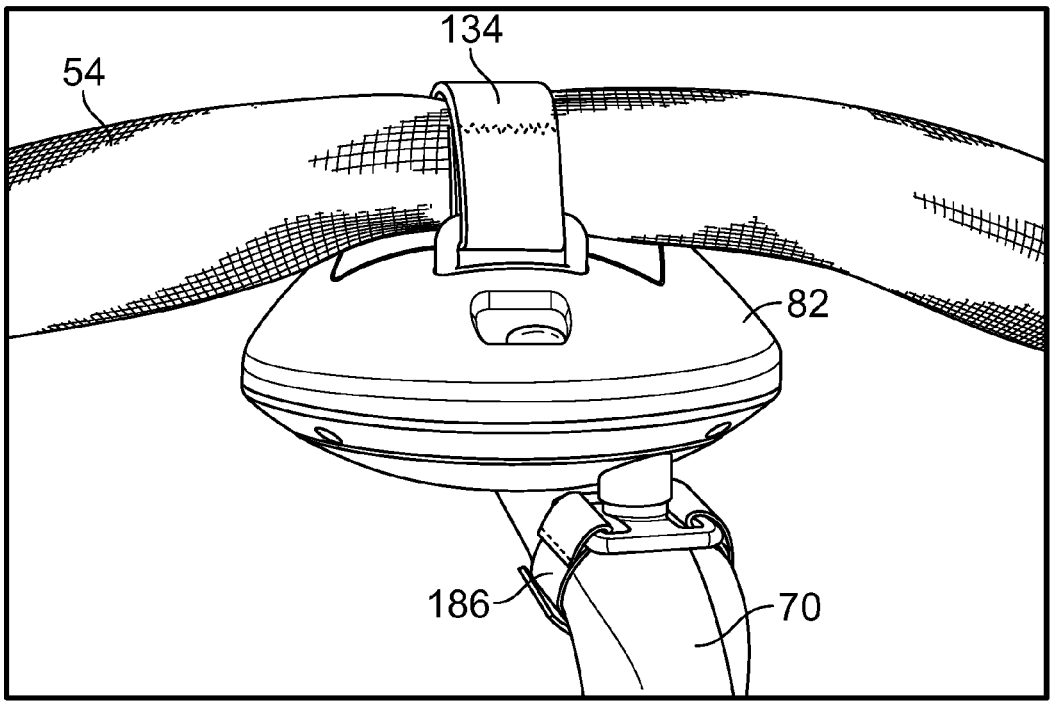
FIG. 5 is a perspective view of the electronics module coupled to two flexible members of the play gym illustrated in FIG. 1.
Figure 6:
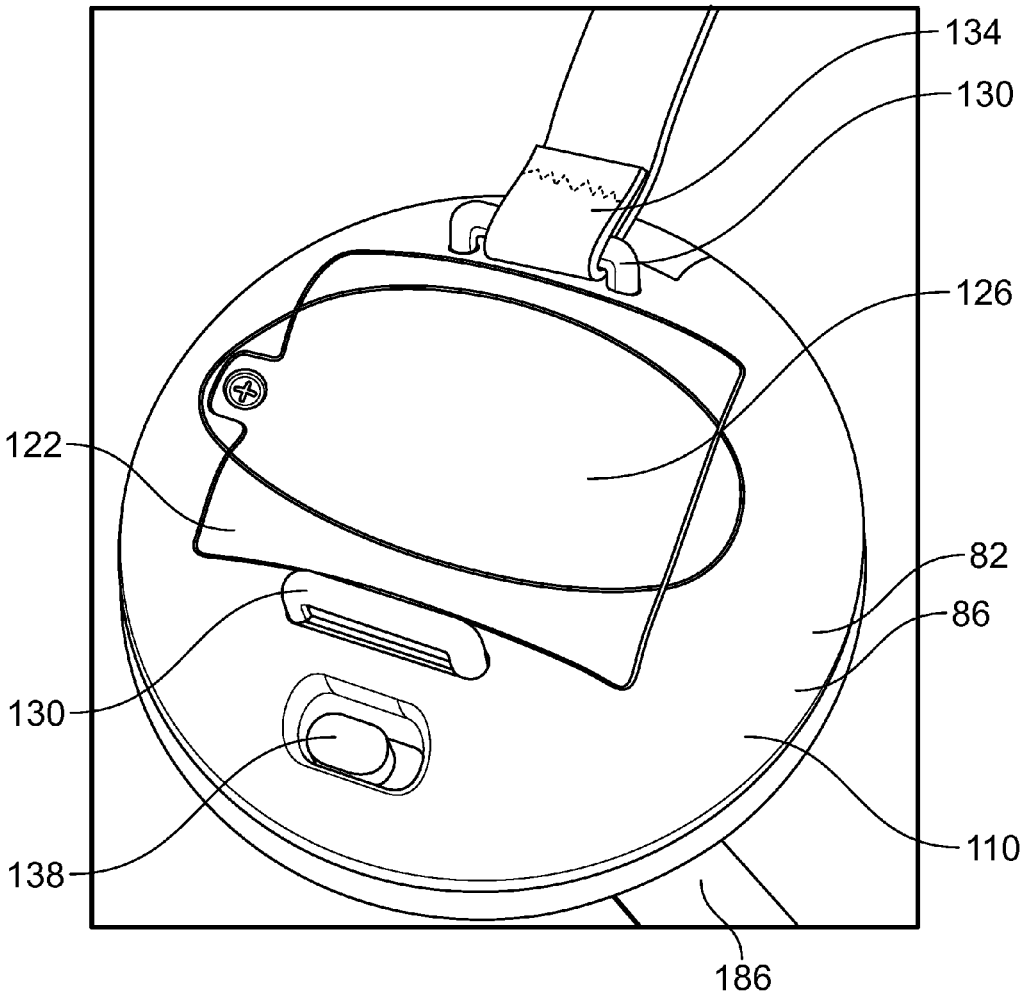
FIG. 6 is a top view of the electronics module of the play gym illustrated in FIG. 1.
Figure 7:
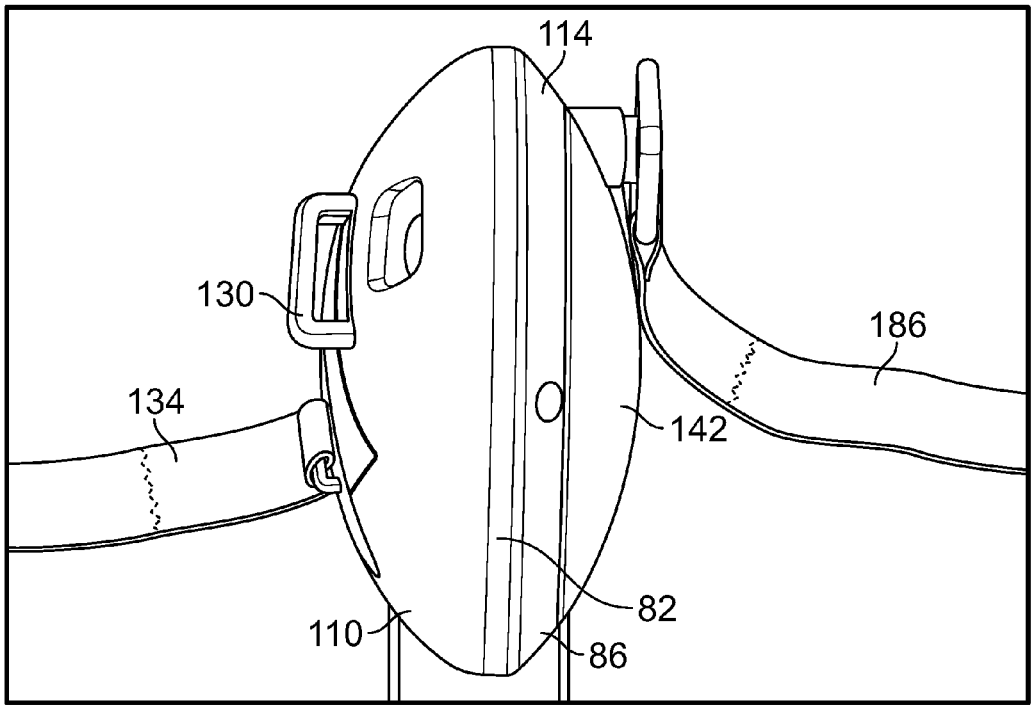
FIG. 7 is a side view of the electronics module of the play gym illustrated in FIG. 1.
Figure 8:
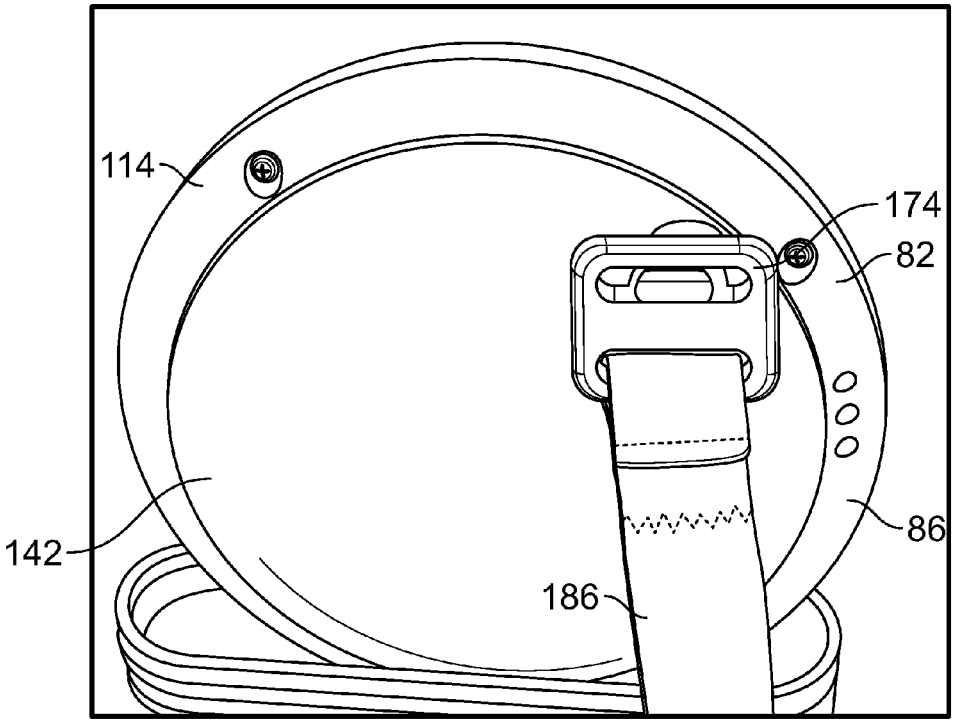
FIG. 8 is a rear view of the electronics module of the play gym illustrated in FIG. 1.

The housing 86 also includes a second portion 114 coupled to the first portion 110 as illustrated in FIGS. 4, 5, and 7. The second portion 114 of the housing 86 includes a compartment 146 configured to support the speaker 98 and a compartment 148 configured to support the gear train 106. The gear train 106 includes a first gear 150 coupled to an output shaft 154 of the motor 102, a second gear 158 coupled to a shaft 162 on the third portion 142, and a plurality of intermediate gears positioned between the first gear 150 and the second gear 158. The gear train 106 is driven by the motor 102 when the motor 102 is activated to thereby cause the third portion 142 to rotate.

The third portion 142 of the housing 86 includes an outside edge 166 defining the perimeter and the shaft 162, which is substantially oriented in the center of the third portion 142. The third portion 142 also includes an aperture 168 positioned adjacent to the outside edge 166. The aperture 168 is configured to receive a post 170 of a bracket 174. The post 170 is coupled to a washer 178 and a fastener 182 such that the post can rotate within the aperture with respect to the third portion 142. The bracket 174 is configured to support a strap 186 used to couple the housing 86 to one of the flexible members 22, 34. More particularly, the strap 186 wraps around the shorter flexible member 34 as illustrated in FIG. 5.

When the electronics module 82 is coupled to the flexible members 22, 34 as shown in FIGS. 1 and 5, the motor 102 operates to rotate the third portion 142 of the housing 86 such that the first flexible member 22 moves with respect to the second flexible member 34. The second flexible member 34 also moves with respect to the first flexible member 22 as the post 170 freely rotates within the aperture 166 of the third portion 142. The first flexible member 22 can move about 10 degrees to about 30 degrees on either side of the first plane while the second flexible member 34 can move about 10 degrees to about 30 degrees on either side of the second plane. The electronics module 82 imparts a swaying motion of the flexible members 22, 34. The swaying motion of the flexible members 22, 34 causes any toys suspended from the attachment points to move thereby entertaining an infant lying on the mat 14.

In another configuration, the electronics module 82 can be configured to move along one of the flexible members 22, 34. For example, the electronics module 82 may be arranged to slide along the first flexible member 22 between two raised portions, such that relative forces created during movement of the third portion 142 and second flexible member 34 cause the electronics module 82 to slide backwards and forwards on the first flexible member 22. This can increase the relative movement between the two flexible members 22, 34. Alternatively, the electronics module 82 can be arranged on a ratchet system or other system that enables the electronics module 82 to move along the flexible member 22, 34, so that the relative movement between the two flexible members 22, 34 is greater.

The foregoing is provided for purposes of illustrating, explaining, and describing embodiments of the invention. Modifications and adaptations to these embodiments will be apparent to those skilled in the art and may be made without departing from the scope or spirit of this invention.

Various features and advantages of the invention are set forth in the following claims.

What is claimed is:

1. A play gym comprising:

a mat;

a first arched structure positioned over and coupled to the mat;

a second arched structure positioned over and coupled to the mat;

a housing coupled to the first arched structure and the second arched structure, the housing including a first portion and a second portion configured to rotate with respect to the first portion;

a power source supported by the housing; and a motor positioned within the housing and powered by the power source, the motor configured to rotate the second portion of the housing to thereby cause the first and second arched structures to move with respect to one another, wherein the first portion of the housing includes a first coupling member extending therefrom and wherein the second portion of the housing includes a second coupling member extending therefrom and rotatable with respect to the first coupling member, wherein the second coupling member rotates about an axis, and wherein the second coupling member includes an eccentrically positioned bracket.

2. The play gym of claim 1, wherein the first coupling member is couplable to one of the first arched structure and the second arched structure, and wherein the second coupling member is couplable to the other of the first arched structure and the second arched structure.

3. The play gym of claim 1, further comprising a gear train operatively coupling together the motor and at least one of the first coupling member and the second coupling member, wherein operation of the motor results in rotation of the first coupling member with respect to the second coupling member.

4. The play gym of claim 1, wherein at least one of the first coupling member and the second coupling member includes a support strap to secure the motion module to at least one of the first arched structure and the second arched structure.

5. The play gym of claim 1, wherein the bracket is couplable to the other of the first arched structure and the second arched structure.

6. A play gym comprising:

a first arched structure coupled to a mat;

a second arched structure coupled to the mat and positioned to extend over the first arched structure, the second arched structure having a length greater than a length of the first arched structure;

a housing including a first portion and a second portion, the first portion having a first coupling member couplable to the second arched structure, the second portion having a second coupling member couplable to the first arched structure, wherein movement of the second portion of the housing causes the second coupling member to rotate with respect to the first coupling member, and wherein rotation of the second coupling member causes the first arched structures to move with respect to the second arched structure; and a motor supported by the housing, and wherein the motor is configured to activate rotation of the second portion of the housing with respect to the first portion of the housing, wherein the second coupling member rotates about an axis, and wherein the second coupling member includes an eccentrically positioned bracket.

7. The play gym of claim 6, wherein the bracket is couplable to the first arched structure.

8. The play gym of claim 6, further comprising a power source configured to provide power to the motor and operatively coupled between the first coupling member and the second coupling member.

9. The play gym of claim 6, wherein at least one of the first coupling member and the second coupling member includes a strap.

10. A play gym comprising:

a mat having a support surface for supporting an infant;

a first arched structure coupled to and extending over the mat;

a second arched structure coupled to and extending over the mat and the first arched structure; and a motion module positioned between the first arched structure and the second arched structure, the motion module including:

a housing having a first coupling member coupled to the second arched structure, and a second coupling member rotatable with respect to the first coupling member and coupled to the first arched structure, wherein rotation of the second coupling member with respect to the first coupling member causes the first and second arched structures to move with respect to one another, wherein the second coupling member rotates about an axis, and wherein the second coupling member includes an eccentrically positioned bracket.

11. The play gym of claim 10, wherein at least one of the first arched structure and the second arched structure includes a flexible member substantially covered with a sleeve of fabric.

12. The play gym of claim 10, further comprising one or more toy members coupled to one of the first arched structure and the second arched structure, and wherein the toy members may include any one of stuffed animals, mirrors, brightly colored objects, bells, and rattles.

13. The motion module of claim 10, wherein the bracket is couplable to the first arched structure.

14. The motion module of claim 10, further comprising a power source, and a motor powered by the power source and operatively coupled to the second coupling member, wherein operation of the motor causes the second coupling member to rotate with respect to the first coupling member.

15. The motion module of claim 10, wherein at least one of the first coupling member and the second coupling member includes a strap to secure the motion module to at least one of the first arched structure and the second arched structure.

* * * * *